US007278274B2

(12) United States Patent
Kim

(10) Patent No.: US 7,278,274 B2
(45) Date of Patent: Oct. 9, 2007

(54) CONDENSATE EVAPORATION DEVICE

(76) Inventor: Brian S. Kim, 7004 Calle Del Pajarito, Rancho Palos Verdes, CA (US) 90275

( * ) Notice: Subject to any disclaimer, the term of this patent is extended or adjusted under 35 U.S.C. 154(b) by 98 days.

(21) Appl. No.: 11/318,653

(22) Filed: Dec. 27, 2005

(65) Prior Publication Data

US 2007/0144197 A1 Jun. 28, 2007

(51) Int. Cl.
*F25B 47/00* (2006.01)

(52) U.S. Cl. ..... 62/280; 62/285

(58) Field of Classification Search ..... 62/279, 62/280, 285, 176.1, 446
See application file for complete search history.

(56) References Cited

U.S. PATENT DOCUMENTS 2,758,449 A * 8/1956 Wallenbrock ..... 62/418
4,378,679 A * 4/1983 Stocking et al. ..... 62/280
5,881,566 A * 3/1999 Shacklock et al. ..... 62/277

* cited by examiner

*Primary Examiner*—Melvin Jones
(74) *Attorney, Agent, or Firm*—John K. Park; Park Law Firm

(57) ABSTRACT

A refrigerator includes a storage space that is cooled by a refrigerant, a compressor that compresses the refrigerant, and a condensate evaporation device. The condensate evaporation device includes a container that contains condensate that flows out of the storage space, a heat exchange device that is adapted to exchange heat between the refrigerant and the condensate, a chamber that is positioned above the container, a condensate spraying device that is adapted to spray condensate within the chamber and a blower that induces air flow within the chamber, so that evaporated condensate is exhausted from the chamber. The condensate evaporation device is positioned adjacent the compressor, and air out of the chamber is guide to the compressor.

19 Claims, 7 Drawing Sheets

CONDENSATE EVAPORATION DEVICE

BACKGROUND OF THE INVENTION

The present invention relates to a condensate evaporation device for a refrigerator. More particularly, this invention relates to a condensate evaporation device that is compact in size and efficient in evaporation by combining heat exchange, air flow and dispersion of condensate in the air flow.

A refrigerator cools down the temperature of a storage space. Condensate is generated when the air is cooled down below the dew point and water vapor is condensed into water droplets. Water droplets are collected and the collected water, that is, the condensate is exhausted from the storage space. The condensate exhausted thereby is evaporated rather than discharged into the sewer because of regulatory reasons that require costly processes for discharging condensate to the sewer.

In order to evaporate the condensate water, heat exchange requires large heat exchange area, and bulky evaporation devices were used to meet the evaporation capacity.

The space requirement for refrigerators for commercial use has continued to become more severe. For a given size of a refrigerator, the storage space is requested to be maximized in order to maximize the goods display space, which means less space is reserved for functional parts of a refrigerator including a condensate evaporation device.

Accordingly, a need for a more efficient and more compact condensate evaporation device for refrigerators has been present for a long time considering the tendency of growing in capacity of refrigerator. This invention is directed to solve these problems and satisfy the long-felt need.

SUMMARY OF THE INVENTION

The present invention contrives to solve the disadvantages of the prior art.

An object of the invention is to provide a compact condensate evaporation device for a commercial refrigerator.

Another object of the invention is to provide a condensate evaporation device that is highly efficient in heat exchange.

Still another object of the invention is to provide a condensate evaporation device, the spatial relation with other parts of the refrigerator helps to improve efficiency of the refrigerator.

In order to achieve the above objects, the present invention provides a condensate evaporation device for a refrigerator. The refrigerator includes a storage space that is cooled by refrigerant, and a compressor that compresses the refrigerant. The condensate evaporation device includes a container that is adapted to contain condensate that flows out of the storage space, a heat exchange device that is adapted to exchange heat between the refrigerant and the condensate, a chamber that is positioned above the container, a condensate spraying device that is adapted to spray condensate within the chamber, and a blower that induces air flow within the chamber, so that evaporated condensate is exhausted from the chamber.

The container includes a pan. The heat exchange device includes a refrigerant pipe through which the refrigerant flows. The refrigerant pipe is installed near the bottom of the pan so that the refrigerant pipe is immersed in the condensate.

The chamber includes one or more air vents that allow air flow into or out of the chamber. The air vent includes a slanted wall. The condensate spraying device is adapted to suck condensate from condensate contained in the container and to spray the sucked condensate within the chamber.

The condensate spraying device includes a condensate sprayer cone and a condensate sprayer plate. The sprayer cone is hollow and includes a flow-in opening near the apex of the sprayer cone, and a flow-out opening at the base of the sprayer cone. The condensate sprayer plate is fixed to the condensate sprayer cone at the base of the sprayer cone.

The condensate spraying device further includes a motor that rotates the condensate sprayer plate and the condensate sprayer cone. The condensate moves upward inside the condensate sprayer cone by centrifugal force.

The condensate sprayer plate includes a plate disc and one or more projections that protrudes from the plate disc. The condensate sprayer cone further includes a flange at the base of the sprayer cone. The projections abut the flange, so that the condensate is sprayed through openings between the sprayer cone, the plate disc of the condensate sprayer plate and the projections of the condensate sprayer plate.

The chamber includes one or more meshed walls. The condensate is sprayed onto the meshed walls. The meshed walls include a cylindrical meshed wall that surrounds the condensate sprayer cone.

The meshed walls further include a circular meshed wall that meets with the cylindrical wall, and is positioned slightly above the base of the condensate sprayer cone.

Each of the circular meshed wall and the cylindrical meshed wall includes two adjacent meshed plates.

The condensate evaporation device further includes a condensate level sensor. The condensate level sensor is installed inside the pan and detects the level of the condensate inside the pan. The motor of the condensate spraying device and the blower are operated when the level of condensate detected by the condensate level sensor is above a predetermined value.

In a refrigerator in which the condensate evaporation device is installed, the condensate evaporation device is positioned adjacent the compressor, and air out of the chamber is guided to the compressor.

The advantages of the present invention are: (1) the condensate evaporation device is compact; (2) the condensate evaporation device effectively uses heat exchange between the hot compressed and liquefied refrigerant and the cold condensate; (3) the condensate evaporation device maximizes surface area of condensate that is contact with ambient air; (4) the condensate evaporation device uses the still cool exhaust air that contains evaporated condensate to cool down the hot compressor.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
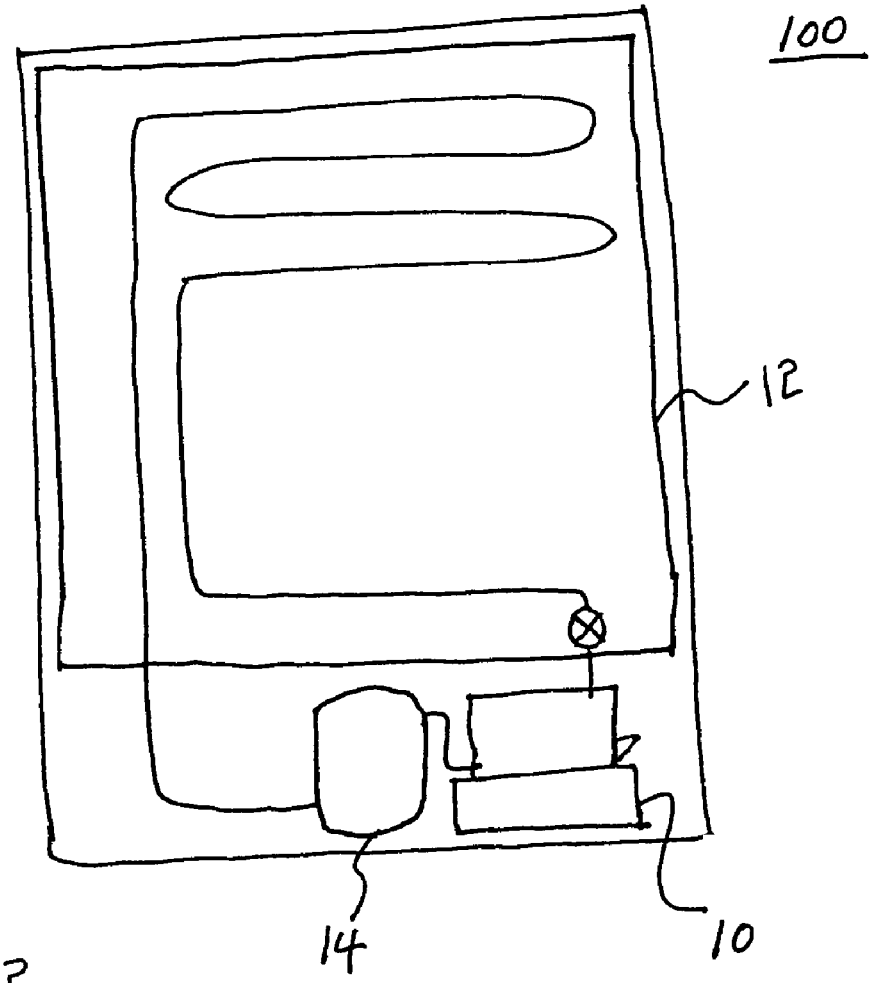
FIG. 1 is a schematic elevation view of a refrigerator with a condensate evaporation device according to the present invention installed.

FIG. 1 shows a refrigerator 100 with a condensate evaporation device 10 installed.

Figure 2:
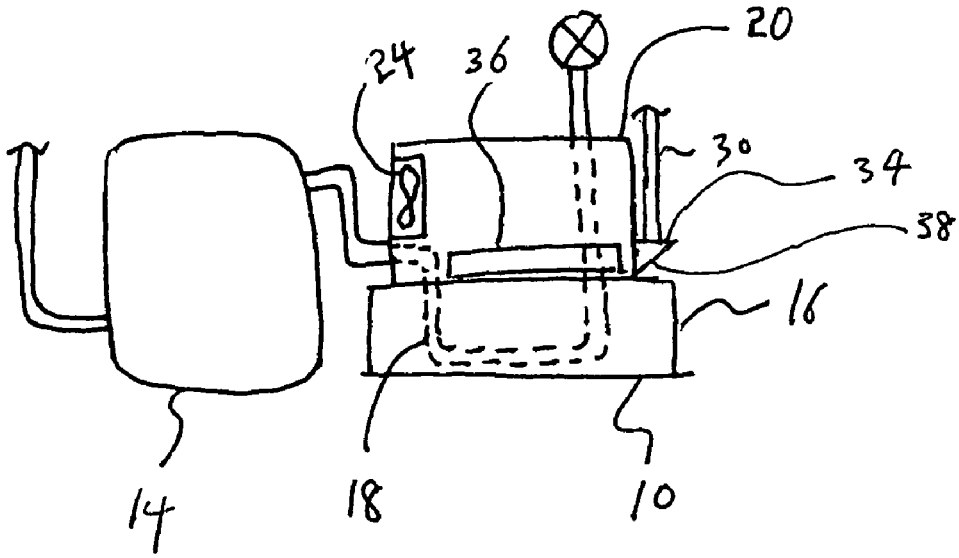
FIG. 2 is a schematic elevation view of a compressor and the condensate evaporation device positioned side by side.
Figure 3:
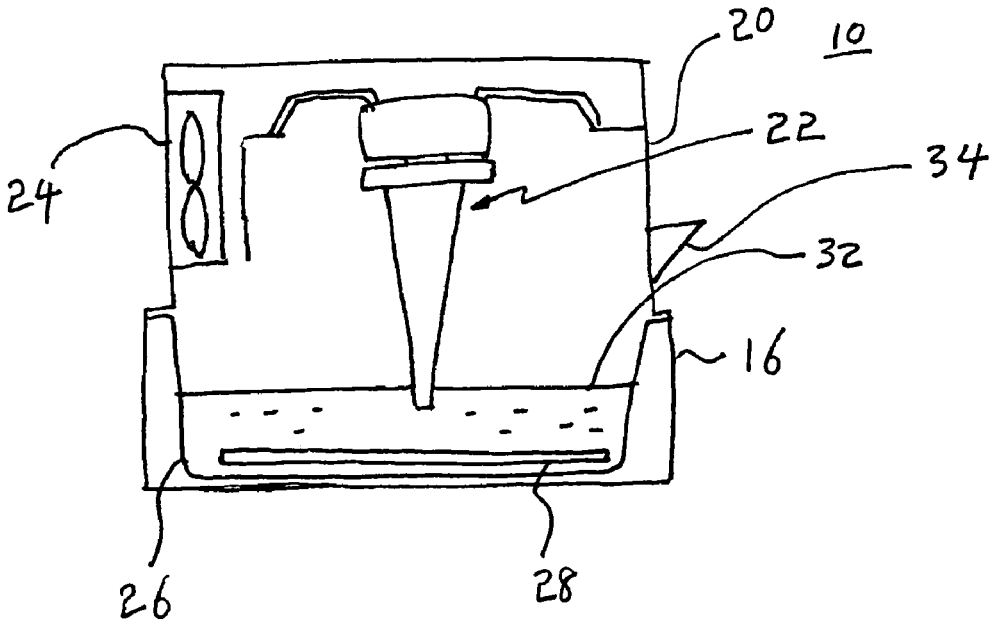
FIG. 3 is a schematic cross-sectional view of the condensate evaporation device.

The refrigerator 100 includes a storage space 12 that is cooled by refrigerant, and a compressor 14 that compresses the refrigerant. FIGS. 2 and 3 show that the condensate evaporation device 10 includes a container 16 that is adapted to contain condensate that flows out of the storage space 12, which is guided into the container 16 through a condensate conduit 30, a heat exchange device 18 that is adapted to exchange heat between the refrigerant and the condensate, a chamber 20 that is positioned above the container 16, a condensate spraying device 22 that is adapted to spray condensate within the chamber 20, and a blower 24 that induces air flow within the chamber 20, so that evaporated condensate is exhausted from the chamber 20. This heating greatly facilitates evaporation of condensate.

Figure 4:
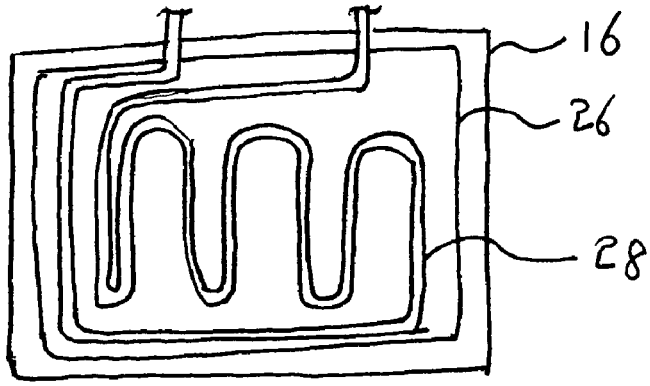
FIG. 4 is a top view showing a pan for containing condensate and a refrigerant pipe that are immersed in the condensate.

As shown in FIGS. 3 and 4, the container 16 includes a pan 26. The heat exchange device 18 includes a refrigerant pipe 28 through which the refrigerant flows. The refrigerant pipe 28 is installed near the bottom of the pan 26 so that the refrigerant pipe 28 is immersed in the condensate 32. In this way, cold condensate is heated by the hot refrigerant that flows through the refrigerant pipe 28. The refrigerant is hot since it is compressed and liquefied state.

Figure 12:
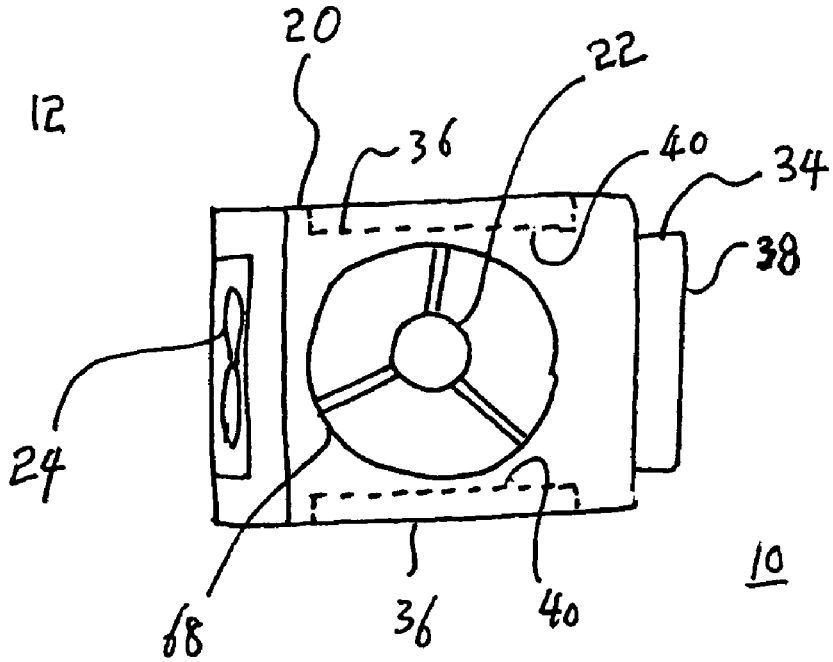
FIG. 12 is a plan view of the condensate evaporation device without a top cover.

As shown in FIG. 2, the chamber 20 includes one or more air vents 34, 36 that allow air flow into or out of the chamber 20. The air vents 34, 36 include a slanted wall. In FIG. 2, the air vent 34 includes a slanted wall 38 that protrudes outside of the chamber 20. FIG. 12 shows that the air vent 36 includes a slanted wall 40 that is recessed into the chamber 20. The slanted walls 38, 40 prevent the condensate from being sprayed outside the chamber 20.

Figure 5:
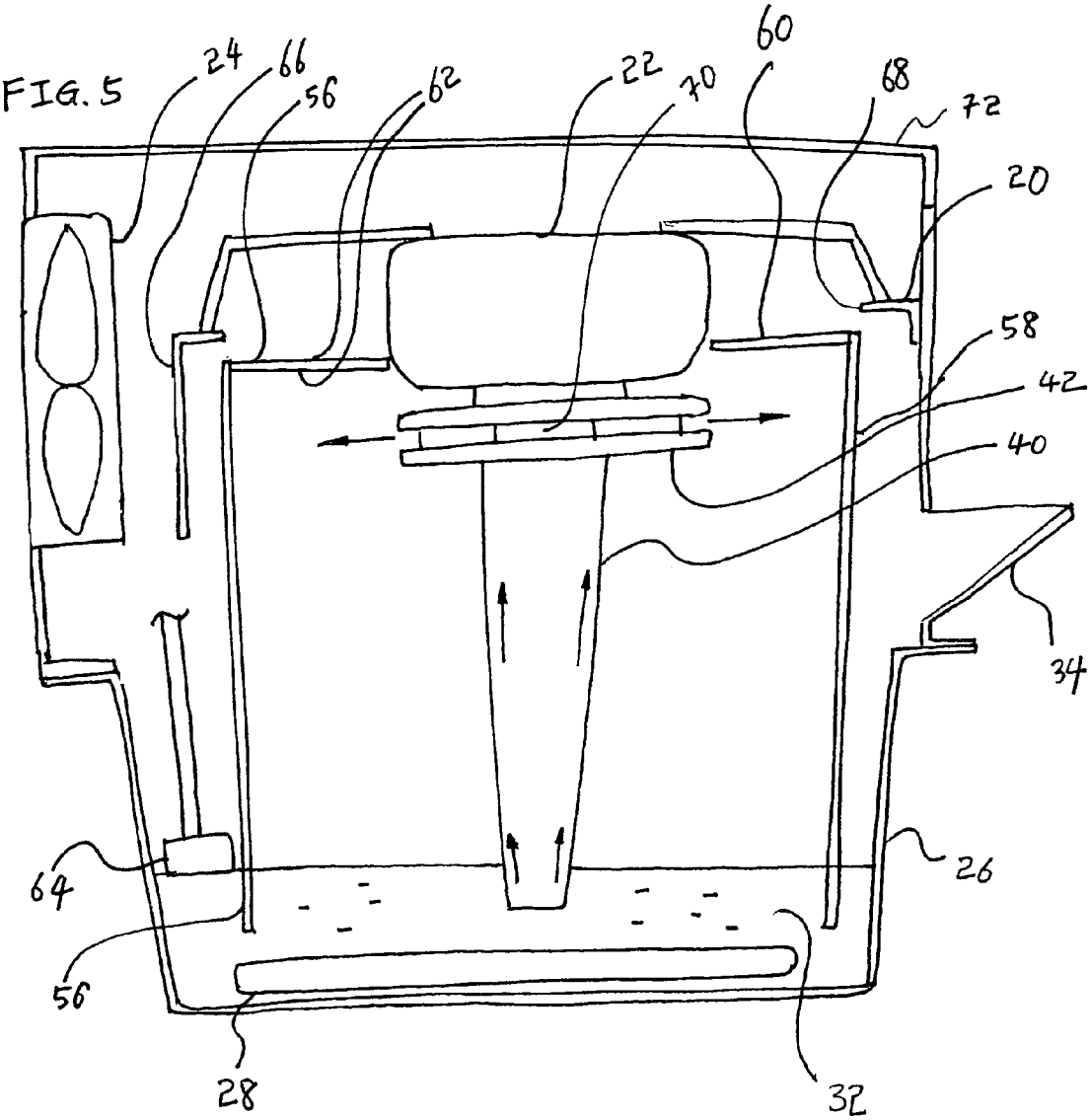
FIG. 5 is a cross-sectional view of the condensate evaporation device.

FIGS. 3 and 5 show that the condensate spraying device 22 is adapted to suck condensate from condensate 32 contained in the container 16 and to spray the sucked condensate within the chamber 20.

Figure 10:
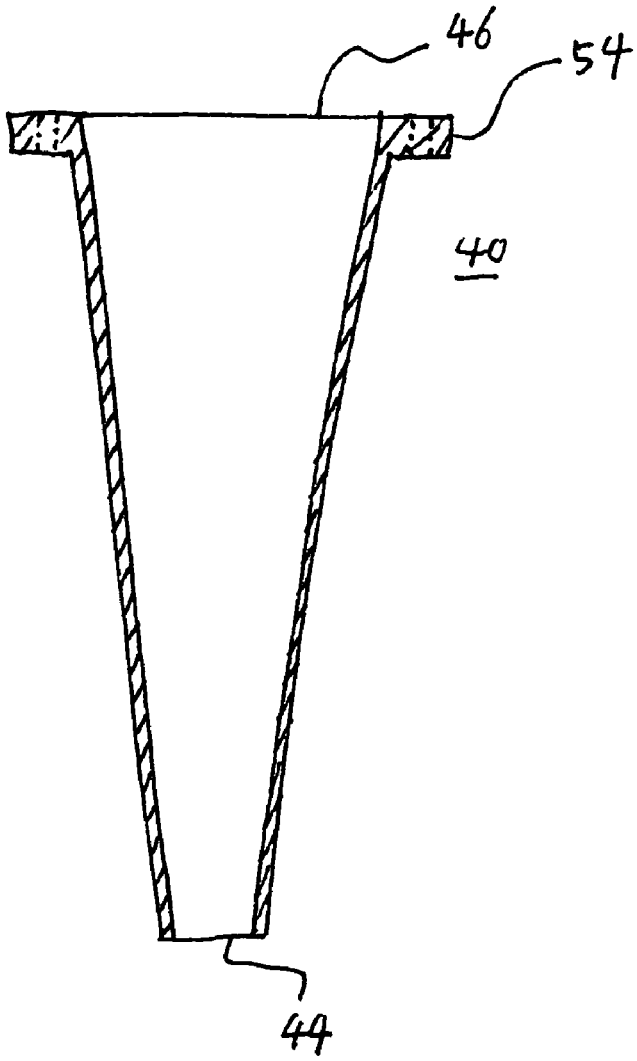
FIG. 10 is a cross-sectional view of the sprayer cone taken along line X-X in FIG. 9.

The condensate spraying device 22 includes a condensate sprayer cone 40 and a condensate sprayer plate 42. As shown well in FIG. 10, the sprayer cone 40 is hollow and includes a flow-in opening 44 near the apex of the sprayer cone 40, and a flow-out opening 46 at the base of the sprayer cone 40. The condensate sprayer plate 42 is fixed to the condensate sprayer cone 40 at the base of the sprayer cone 40.

Figure 6:
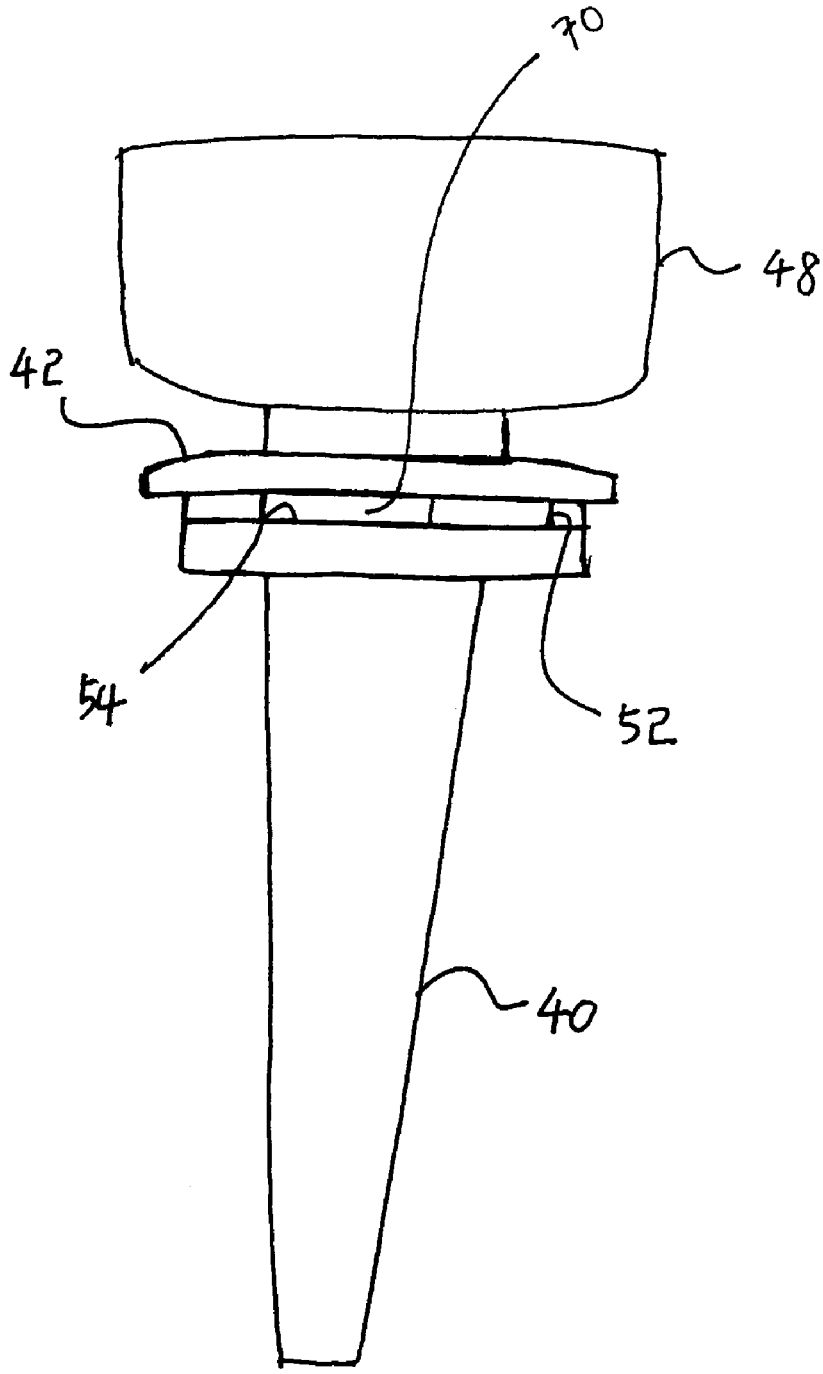
FIG. 6 is an elevation view of a condensate sprayer and a motor that rotates the condensate sprayer.
Figure 7:
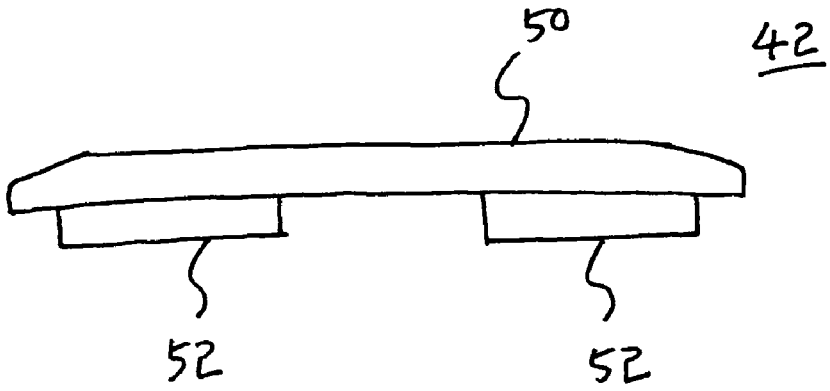
FIG. 7 is a side elevation view showing a sprayer plate.
Figure 8:
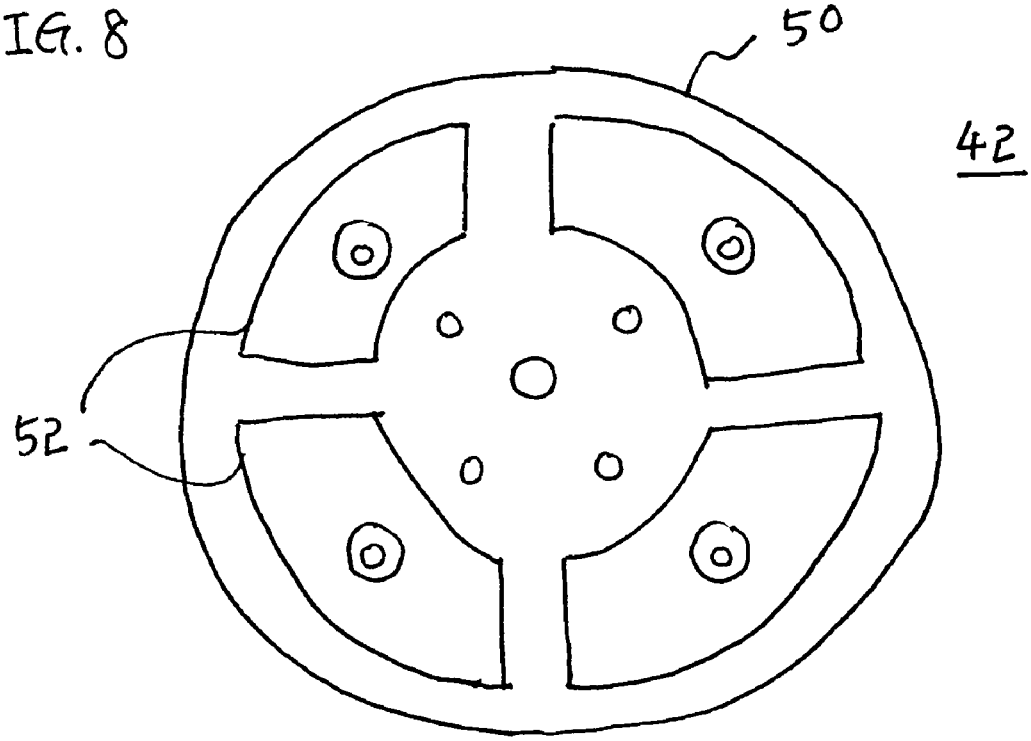
FIG. 8 is a bottom view showing the sprayer plate.
Figure 9:
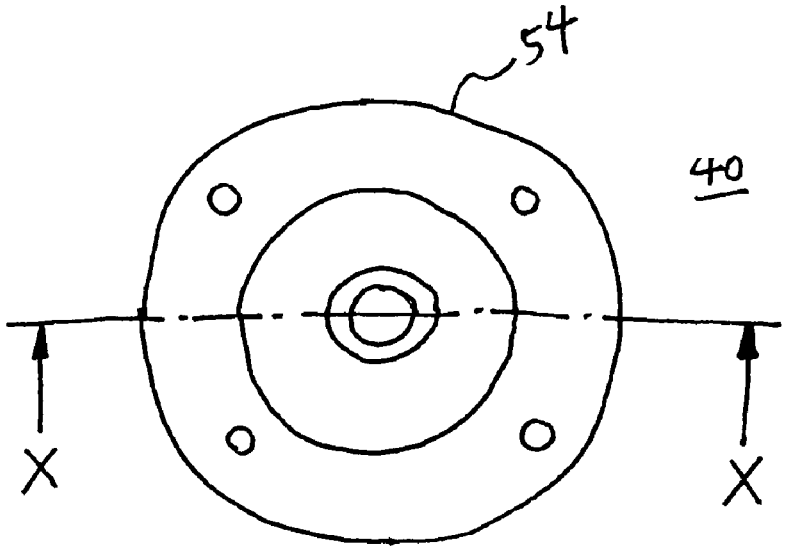
FIG. 9 is a top view showing a sprayer cone.

As shown in FIGS. 5 and 6, the condensate spraying device 22 further includes a motor 48 that rotates the condensate sprayer plate 42 and the condensate sprayer cone 40. The condensate moves upward inside the condensate sprayer cone 40 and then sprayed radially by centrifugal force as shown by arrows in FIG. 5. FIGS. 7 and 8 show that the condensate sprayer plate 42 includes a plate disc 50 and one or more projections 52 that protrudes from the plate disc 50. FIG. 6 shows that the condensate sprayer cone 40 further includes a flange 54 at the base of the sprayer cone 40. The projections 52 abut the flange 54, so that the condensate is sprayed through openings 70 between the sprayer cone 40, the plate disc 50 of the condensate sprayer plate 42 and the projections 52 of the condensate sprayer plate 42.

As shown in FIG. 5, the chamber 20 includes one or more meshed walls 56. The condensate is sprayed onto the meshed walls 56. The meshed walls 56 include a cylindrical meshed wall 58 that surrounds the condensate sprayer cone 40.

Figure 11:
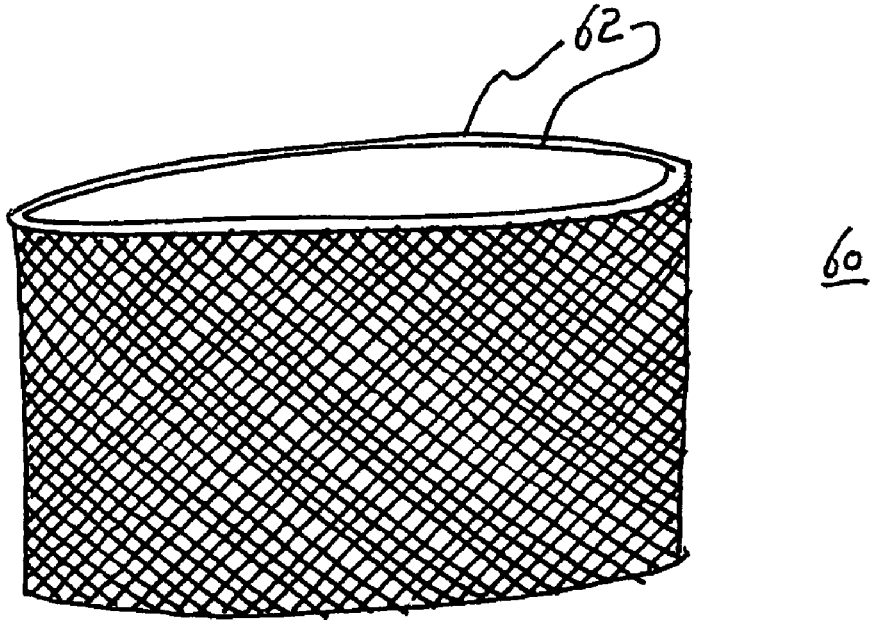
FIG. 11 is a perspective view of a cylindrical meshed wall.

The meshed walls 56 further include a circular meshed wall 60 that meets with the cylindrical meshed wall 58, and is positioned slightly above the base of the condensate sprayer cone 40. The circular meshed wall 60 and the cylindrical wall 58 comprise two adjacent meshed plates 62 (refer to FIGS. 11 and 5).

The meshed walls 56 hold the sprayed condensate while allowing air flow through their meshes. In this way, contact area of condensate that are exposed on air flow dramatically increases. As shown in FIG. 5, the condensate evaporation device further includes a condensate level sensor 64. The condensate level sensor 64 is installed inside the pan 26 and detects the level of the condensate 32 inside the pan 26. The motor 48 of the condensate spraying device 22 and the blower 24 may be controlled to operate when the level of condensate 32 detected by the condensate level sensor 64 is above a predetermined value.

A top cover 72 is provided to cover the entire condensate evaporation device 10 above the chamber 20.

In the refrigerator 100 in which the condensate evaporation device 10 is installed, the condensate evaporation device 10 is positioned adjacent the compressor 14, and air out of the chamber 20 is guided to the compressor 14. This facilitates cooling of refrigerant.

FIG. 5 shows that the chamber 20 includes a spray blocking wall 66, and an upper opening 68. The spray blocking wall 66 is positioned between the blower 24 and the condensate sprayer plate 42 so that condensate sprayed radially from the condensate spraying device 22 is not allowed to enter directly into the blower 24. The upper opening 68 is provided around the motor 48 of the condensate spraying device 42, and the circular meshed wall 60 is assembled adjacent to the upper opening 68.

The air flows into the chamber 20 through the air vents 34, 36 and flows out of the chamber 20 through the upper opening 68 and between the spray blocking wall 66 and the pan 26. The direction of air flow may be reversed according to the air flow direction induced by the blower 24.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A condensate evaporation device for a refrigerator, wherein the refrigerator includes a storage space that is cooled by refrigerant, and a compressor that compresses the refrigerant, the device comprising:

a) a container that is adapted to contain condensate that flows out of the storage space;
b) a heat exchange device that is adapted to exchange heat between the refrigerant and the condensate;
c) a chamber that is positioned above the container;
d) a condensate spraying device that is adapted to spray condensate within the chamber; and
e) a blower that induces air flow within the chamber, whereby evaporated condensate is exhausted from the chamber.

2. The condensate evaporation device of claim 1, wherein the container comprises a pan, wherein the heat exchange device comprises a refrigerant pipe through which the refrigerant flows, wherein the refrigerant pipe is installed near the bottom of the pan whereby the refrigerant pipe is immersed in the condensate.

3. The condensate evaporation device of claim 1, wherein the chamber includes one or more air vents that allow air flow into or out of the chamber.

4. The condensate evaporation device of claim 3, wherein the air vent comprises a slanted wall.

5. The condensate evaporation device of claim 1, wherein the condensate spraying device is adapted to suck condensate from condensate contained in the container and to spray the sucked condensate within the chamber.

6. The condensate evaporation device of claim 5, wherein the chamber comprises one or more meshed walls, wherein the condensate is sprayed onto the meshed walls.

7. The condensate evaporation device of claim 5, wherein the condensate spraying device comprises a condensate sprayer cone and a condensate sprayer plate, wherein the sprayer cone is hollow and comprises a flow-in opening near the apex of the sprayer cone, and a flow-out opening at the base of the sprayer cone, wherein the condensate sprayer plate is fixed to the condensate sprayer cone at the base of the sprayer cone.

8. The condensate evaporation device of claim 7, wherein the condensate spraying device further comprises a motor that rotates the condensate sprayer plate and the condensate sprayer cone, whereby the condensate moves upward inside the condensate sprayer cone by centrifugal force.

9. The condensate evaporation device of claim 8, wherein the condensate sprayer plate comprises a plate disc and one or more projections that protrudes from the plate disc, wherein the condensate sprayer cone further comprises a flange at the base of the sprayer cone, wherein the projections abut the flange, whereby the condensate is sprayed through openings between the sprayer cone, the plate disc of the condensate sprayer plate and the projections of the condensate sprayer plate.

10. The condensate evaporation device of claim 8, wherein the chamber comprises one or more meshed walls, wherein the condensate is sprayed onto the meshed walls, wherein the meshed walls comprise a cylindrical meshed wall that surrounds the condensate sprayer cone.

11. The condensate evaporation device of claim 10, wherein the meshed walls further comprise a circular meshed wall that meets with the cylindrical wall, and is positioned slightly above the base of the condensate sprayer cone.

12. The condensate evaporation device of claim 11, further comprising a condensate level sensor, wherein the condensate level sensor is installed inside the pan and detects the level of the condensate inside the pan.

13. The condensate evaporation device of claim 12, wherein the motor of the condensate spraying device and the blower are operated when the level of condensate detected by the condensate level sensor is above a predetermined value.

14. The condensate evaporation device of claim 11, wherein each of the circular wall and the cylindrical wall comprises two adjacent meshed plates.

15. A refrigerator comprising:
i) a storage space that is cooled by a refrigerant,
ii) a compressor that compresses the refrigerant, and
iii) a condensate evaporation device, wherein the condensate evaporation device comprising:
a) a container that is adapted to contain condensate that flows out of the storage space;
b) a heat exchange device that is adapted to exchange heat between the refrigerant and the condensate;
c) a chamber that is positioned above the container;
d) a condensate spraying device that is adapted to spray condensate within the chamber; and
e) a blower that induces air flow within the chamber, whereby evaporated condensate is exhausted from the chamber.

16. The refrigerator of claim 15, wherein the condensate evaporation device is positioned adjacent the compressor, and air out of the chamber is guided to the compressor.

17. The refrigerator of claim 16, wherein the container comprises a pan, wherein the heat exchange device comprises a refrigerant pipe through which the refrigerant flows, wherein the refrigerant pipe is installed near the bottom of the pan whereby the refrigerant pipe is immersed in the condensate.

18. The refrigerator of claim 17, wherein the condensate spraying device is adapted to suck condensate from condensate contained in the container and to spray the sucked condensate within the chamber.

19. The refrigerator of claim 18, wherein the chamber comprises one or more meshed walls, wherein the condensate are sprayed onto the meshed walls.

* * * * *